US007347669B1

(12) United States Patent
Patrick et al.

(10) Patent No.: US 7,347,669 B1
(45) Date of Patent: Mar. 25, 2008

(54) SENSOR-ACTUATED POWER FAN

(76) Inventors: Jeffrey D. Patrick, 2601 Tejas Trail, Leander, TX (US) 78641; Cindy Patrick, 2601 Tejas Trail, Leander, TX (US) 78641

( * ) Notice: Subject to any disclaimer, the term of this patent is extended or adjusted under 35 U.S.C. 154(b) by 392 days.

(21) Appl. No.: 11/065,607

(22) Filed: Feb. 25, 2005

(51) Int. Cl.
*F04D 25/10* (2006.01)

(52) U.S. Cl. ..... 416/31; 416/13

(58) Field of Classification Search ..... 416/31, 416/36, 37

See application file for complete search history.

(56) References Cited

U.S. PATENT DOCUMENTS

| | | | | |
|---|---|---|---|---|
| 1,958,182 | A * | 5/1934 | Cote | 74/43 |
| D319,099 | S | 8/1991 | Cheslock et al. | |
| 5,256,039 | A | 10/1993 | Crawford | |
| 5,805,767 | A | 9/1998 | Jouas et al. | |
| 6,015,262 | A | 1/2000 | Huang | |
| 6,215,956 | B1 | 4/2001 | Lee | |
| 6,283,709 | B1 | 9/2001 | Hill et al. | |
| 6,533,548 | B1 | 3/2003 | Wang et al. | |
| 2003/0068228 | A1 | 4/2003 | Chen-Lung et al. | |

FOREIGN PATENT DOCUMENTS

| | | | |
|---|---|---|---|
| JP | 63297796 | A * | 12/1988 |
| JP | 02005793 | A * | 1/1990 |
| JP | 04308397 | A * | 10/1992 |
| JP | 07180693 | A * | 7/1995 |
| JP | 2000073988 | A * | 3/2000 |

* cited by examiner

*Primary Examiner*—Richard A. Edgar

(57) ABSTRACT

A remotely operable motorized fan includes an elongated support shaft that has top and bottom end portions, and a housing that defines a cavity therein and includes a tubular lower flange positioned about the top end portion of the support shaft. The housing includes monolithically formed platforms to which the power mechanism and the sensing mechanism are secured. A sensing mechanism is included for detecting a mobile target zone remotely located from the housing. The system further includes a power mechanism for rotating the housing about the support shaft based upon a location of the target zone. The power mechanism is electrically coupled to the sensing mechanism such that the housing automatically pivots without requiring a user input.

17 Claims, 4 Drawing Sheets

SENSOR-ACTUATED POWER FAN

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to power fans and, more particularly, to a sensor-actuated power fan for more effectively cooling a person in motion.

2. Prior Art

The use of power fans is known in the prior art. More specifically, power fans heretofore devised and utilized are known to consist basically of familiar, expected, and obvious structural configurations, notwithstanding the myriad of designs encompassed by the crowded prior art which have been developed for the fulfillment of countless objectives and requirements.

Modern electronics has provided the consumer with the ability to remotely control a variety of household appliances. However, this ability has not yet been completely exploited with regard to the control of ventilation devices, or more particularly, to the control of fans. Prior examples in the field have used remote control devices chiefly for the limited purpose of controlling the speed of fan rotation, or for controlling ancillary related functions, such as a light attached to a fan, or for transmitting operational state information about the fan to the user via audible and visual signals. Other aspects of fan operation have not yet been made accessible by remote control.

In addition to controlling a fan's speed of operation, it is often necessary to physically relocate the fan in order to increase the degree of ventilation provided, or substantially change the direction of air flow. The ability to move the entire fan via remote control has not previously been available; this ability would allow the user, particularly those who are sick or handicapped to adjust the location of the fan without physically lifting and carrying it. Likewise, while fans are now readily available with controls for oscillating the fan with respect to its supporting structure, such controls are attached to the structure of the fan and must be directly manipulated to change the oscillation settings.

Accordingly, a need remains for a sensor-actuated power fan in order to overcome the above-noted shortcomings. The present invention satisfies such a need by providing a sensor-actuated power fan that is easy to use, is efficient in operation, and provides comfort and control to the user. Such an automated sensor-actuated power fan enables the fan to automatically remain trained upon an individual as the person moves about a room. Thus, the fan provides a more consistent and effective cooling action. This more effective cooling action is achieved without any compromise in the fan's size, weight, etc.

BRIEF SUMMARY OF THE INVENTION

In view of the foregoing background, it is therefore an object of the present invention to provide a sensor-actuated power fan. These and other objects, features, and advantages of the invention are provided by a remotely operable motorized fan that includes an elongated and rectilinear support shaft that has top and bottom end portions axially registered along a vertical plane.

A housing defines a cavity therein and includes a monolithically formed tubular lower flange protruding downwardly about the top end portion of the support shaft. Such a housing includes a plurality of monolithically formed platforms to which the power mechanism (described herein below) and the sensing mechanism (described herein below) are partially secured.

A sensing mechanism is included for detecting a mobile target zone remotely located from the housing. Such a sensing mechanism is disposed above the support shaft.

The sensing mechanism preferably includes a processor for executing preprogrammed software instructions for causing the power mechanism to operate in a selected mode. A central sensor is conjoined to the housing and partially extends outwardly therefrom. Such a central sensor is electrically coupled to the processor and the power mechanism for communicating therewith during operating conditions. An auxiliary sensor is removably positional on a mobile object and includes a transmitter generating and sending a beacon signal unique to the auxiliary sensor.

The central sensor emits a continuous location signal throughout a predetermined radius surrounding the housing for detecting a real-time location of the auxiliary sensor. Such a central sensor generates an operating signal corresponding to a location of the beacon signal and sends the operating signal to the processor for rotating the housing toward the beacon signal location.

The present invention further includes a power mechanism for rotating the housing about the support shaft based upon a location of the target zone. Such a power mechanism is electrically coupled to the sensing mechanism such that the housing automatically pivots about a vertically situated longitudinal axis bifurcating the housing without requiring a user input.

The power mechanism preferably includes a motor secured within the housing and electrically coupled to the processor. A beveled gear assembly is positioned about the support shaft and operably mated with the power mechanism motor for effectively causing the support shaft and the housing to rotate in sync. Such a beveled gear assembly preferably includes a drive shaft conjoined to the power mechanism motor, a first gear rotatably coupled to the drive shaft, and a second gear that has an annular shape situated about an outer perimeter of the support shaft. The first and second gears are operably mated in such a manner that the second gear is caused to rotate in a second direction when the first gear is rotated in a first direction. Such first and second directions are oriented substantially orthogonal to each other. The power mechanism may further include an annular ring clip that has laterally spaced end portions situated about the outer perimeter of the support shaft and subjacent the second gear.

The fan preferably further includes a rubber seal seated about the support shaft below the ring clip. Such a rubber seal is intercalated between a bottom opening of the housing and the outer perimeter of the support shaft.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
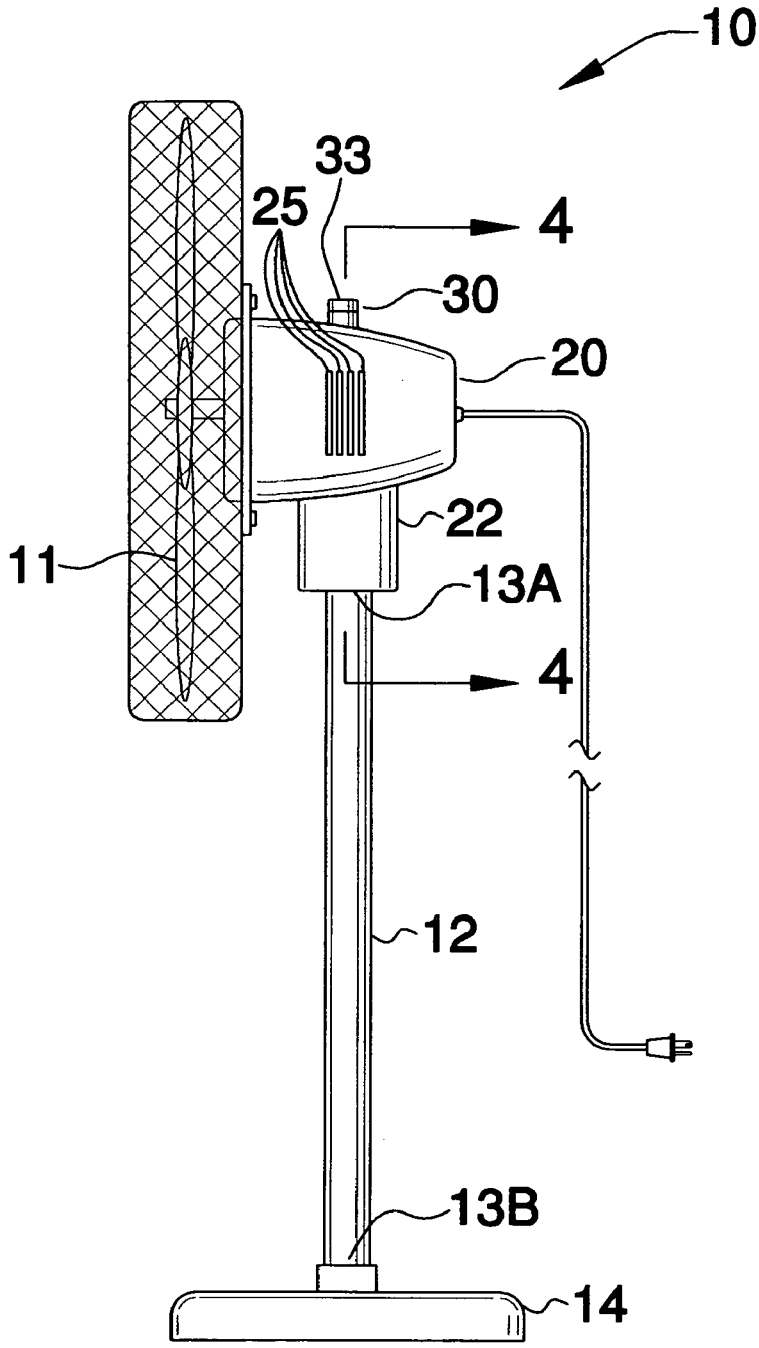
FIG. 1 is a side-elevational view showing a sensor-actuated power fan, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-4 by the reference numeral 10 and is intended to provide a sensor-actuated power fan. It should be understood that the system 10 may be used to remotely operate many different types of fans and should not be limited in use to only power fans.

Referring initially to FIG. 1, the system 10 includes an elongated and rectilinear support shaft 12 that has top 13A and bottom 13B end portions axially registered along a vertical plane. Such an elongated shaft 12 may, of course, further include an annular base 14 attached to the bottom end portion 13B thereof for supporting the system 10, as is obvious to a person of ordinary skill in the art. The base 14 advantageously prevents the system 10 from falling over during operating conditions, which may result in damage to the system 10 or injury to a person standing near the system 10.

Figure 2:
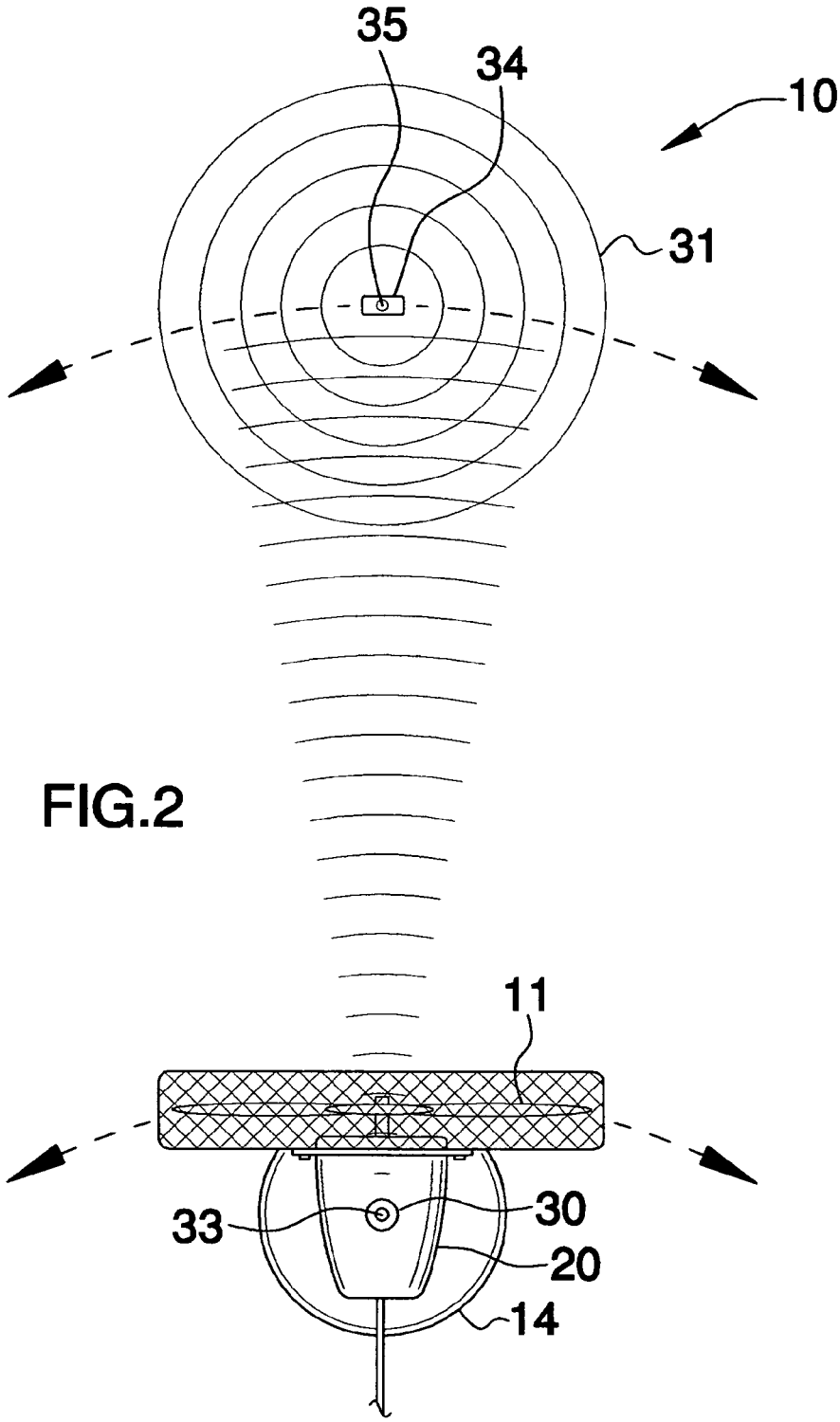
FIG. 2 is a top plan view of the system shown in FIG. 1.
Figure 4:
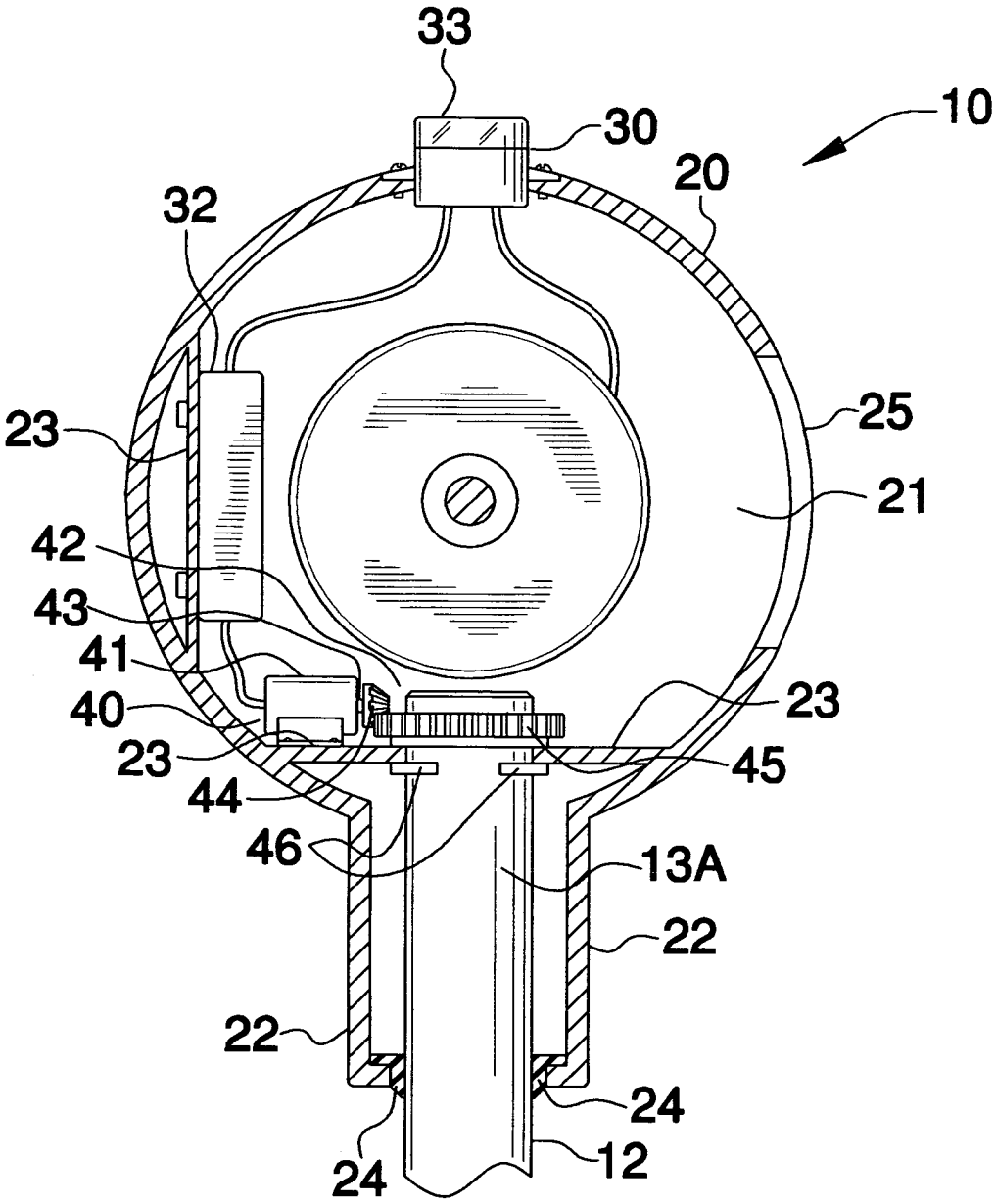
FIG. 4 is a cross-sectional view of the fan shown in FIG. 1, taken along line 4-4.

Referring to FIGS. 1, 2 and 4, a housing 20 defines a cavity 21 therein and includes a monolithically formed tubular lower flange 22 protruding downwardly about the top end portion 13A of the support shaft 12. Such a housing 20 includes a plurality of monolithically formed platforms 23 to which the power mechanism 40 (described herein below) and the sensing mechanism 30 (described herein below) are partially secured. Of course, such a housing 20 and support shaft 12 may be produced in variety of different shapes, sizes and colors, as is obvious to a person of ordinary skill in the art. The housing 20 may further have elongated slits 25 formed on one side thereof for advantageously allowing heat generated by the sensing and the power mechanism to be dissipated from the cavity 21, preventing damage to the system 10, as is obvious to person skilled in the art.

Figure 3:
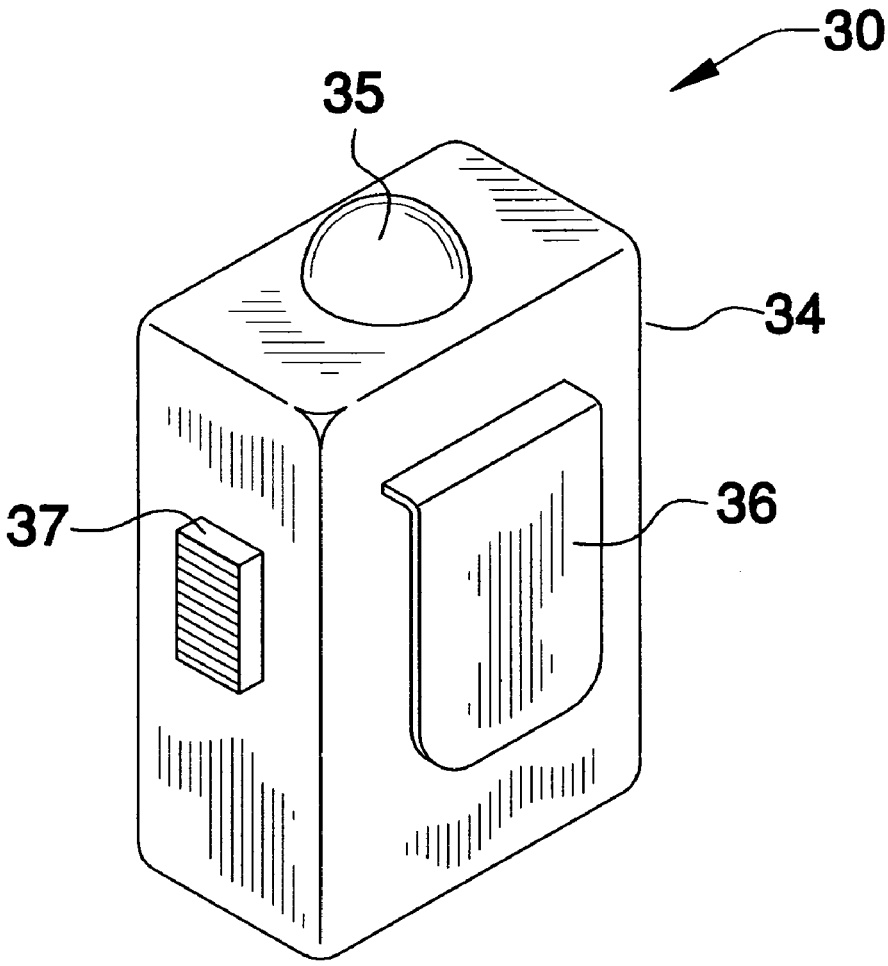
FIG. 3 is an enlarged perspective view of the auxiliary sensor shown in FIG. 2.

Referring to FIGS. 3 and 4, a sensing mechanism 30 is included for effectively detecting a mobile target zone 31 remotely located from the housing 20. Such a sensing mechanism 30 is disposed above the support shaft 12.

Still referring to FIGS. 3 and 4, the sensing mechanism 30 includes a processor 32 for executing preprogrammed software instructions for causing the power mechanism 40 to operate in a selected mode. A central sensor 33 is conjoined to the housing 20 and partially extends outwardly therefrom. Such a central sensor 33 is electrically coupled to the processor 32 and the power mechanism 40 for communicating therewith during operating conditions. An auxiliary sensor 34 is removably positional on a mobile object and includes a transmitter 35 generating and sending a beacon signal unique to the auxiliary sensor 34. Of course, such an auxiliary sensor 34 may include a belt clip member 36 allowing same to be easily attached to a user's waist or other appropriate area, as is obvious to a person of ordinary skill in the art. The belt clip member 36 conveniently allows a person's hands to remain free during working conditions, thus allowing them to be more efficient. The auxiliary sensor 34 may further include an on/off switch 37 for effectively toggling the target zone between activated and deactivated states about a user or other object to which the auxiliary sensor 34 is attached.

Referring to FIG. 2, the central sensor 33 emits a continuous location signal throughout a predetermined radius surrounding the housing 20 for detecting a real-time location of the auxiliary sensor 34. Such a central sensor 33 generates an operating signal corresponding to a location of the beacon signal and sends the operating signal to the processor 32 for rotating the housing 20 toward the beacon signal location and thus, effectively rotates the fan 11 in the direction of the person wearing the auxiliary sensor 34.

Referring to FIG. 4, the present invention further includes a power mechanism 40 for rotating the housing 20 about the support shaft 12 based upon a location of the target zone 31. Such a power mechanism 40 is electrically coupled to the sensing mechanism 30 such that the housing 20 automatically pivots about a vertically situated longitudinal axis bifurcating the housing 20 without requiring a user input. Such an automated power mechanism 40 is especially useful to the elderly and the physically handicapped who may not be capable of manually adjusting the position of the housing 20 and the fan 11 relative to their location.

Still referring to FIG. 4, the power mechanism 40 includes a motor 41 secured within the housing 20 and electrically coupled to the processor 32. A beveled gear assembly 42 is positioned about the support shaft 12 and operably mated with the power mechanism motor 41 for effectively causing the support shaft 12 and the housing 20 to rotate in sync. Such a beveled gear assembly 42 includes a drive shaft 43 conjoined to the power mechanism motor 41, a first gear 44 rotatably coupled to the drive shaft 43, and a second gear 45 that has an annular shape situated about an outer perimeter of the support shaft 12. The first 44 and second 45 gears are operably mated in such a manner that the second gear 45 is caused to rotate in a second direction when the first gear 44 is rotated in a first direction. Such first and second directions are oriented substantially orthogonal to each other.

Again referring to FIG. 4, the power mechanism 40 further includes an annular ring clip 46 that has laterally spaced end portions situated about the outer perimeter of the support shaft 12 and subjacent the second gear 45. The fan system 10 further includes a rubber seal 24 seated about the support shaft 12 below the ring clip 46. Such a rubber seal 24 is intercalated between a bottom opening of the housing 20 and the outer perimeter of the support shaft 12, thus effectively preventing the housing 20 from tilting about a vertical axis in relation to the support shaft 12 and further ensuring a smooth turning motion of the housing 20 about the support shaft 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A remotely operable motorized fan comprising:

an elongated and rectilinear support shaft having top and bottom end portions axially registered along a vertical plane;

a housing defining a cavity therein and including a monolithically formed tubular lower flange protruding downwardly about said top end portion of said support shaft;

sensing means for detecting a mobile target zone remotely located from said housing; and power means for rotating said housing about said support shaft based upon a location of said target zone, said power means being electrically coupled to said sensing means such that said housing automatically pivots about a vertically situated longitudinal axis bifurcating said housing without requiring a user input;

wherein said sensing means comprises:

a processor for executing preprogrammed software instructions for causing said power means to operate in a selected mode;

a central sensor conjoined to said housing and partially extending outwardly therefrom, said central sensor being electrically coupled to said processor and said power means for communicating therewith during operating conditions; and an auxiliary sensor removably positional on a mobile object and including a transmitter generating and sending a beacon signal unique to said auxiliary sensor;

wherein said central sensor emits a continuous location signal throughout a predetermined radius surrounding said housing for detecting a real-time location of said auxiliary sensor, said central sensor generating an operating signal corresponding to a location of said beacon signal and sending said operating signal to said processor for rotating said housing toward said beacon signal location.

2. The fan of claim 1, wherein said power means comprises:

a motor secured within said housing and electrically coupled to said processor; and a beveled gear assembly positioned about said support shaft and operably mated with said power means motor for causing said support shaft to rotate relative to said housing.

3. The fan of claim 2, wherein said beveled gear assembly comprises:

a drive shaft conjoined to said power means motor;

a first gear rotatably coupled to said drive-shaft; and a second gear having an annular shape situated about an outer perimeter of said support shaft;

wherein said first and second gears are operably mated in such a manner that said second gear is caused to rotate in a second direction when said first gear is rotated in a first direction, said first and second directions being oriented substantially orthogonal to each other.

4. The fan of claim 3, wherein said power means further comprises: an annular ring clip situated about the outer perimeter of said support shaft and subjacent said second gear.

5. The fan of claim 4, further comprising: a rubber seal seated about said support shaft below said ring clip, said rubber seal being intercalated between a bottom opening of said housing and the outer perimeter of said support shaft.

6. A remotely operable motorized fan comprising:

an elongated and rectilinear support shaft having top and bottom end portions axially registered along a vertical plane;

a housing defining a cavity therein and including a monolithically formed tubular lower flange protruding downwardly about said top end portion of said support shaft, said housing including a plurality of monolithically formed platforms to which said power means and said sensing means are partially secured;

sensing means for detecting a mobile target zone remotely located from said housing; and power means for rotating said housing about said support shaft based upon a location of said target zone, said power means being electrically coupled to said sensing means such that said housing automatically pivots about a vertically situated longitudinal axis bifurcating said housing without requiring a user input.

7. The fan of claim 6, wherein said sensing means comprises:

a processor for executing preprogrammed software instructions for causing said power means to operate in a selected mode;

a central sensor conjoined to said housing and partially extending outwardly therefrom, said central sensor being electrically coupled to said processor and said power means for communicating therewith during operating conditions; and an auxiliary sensor removably positional on a mobile object and including a transmitter generating and sending a beacon signal unique to said auxiliary sensor;

wherein said central sensor emits a continuous location signal throughout a predetermined radius surrounding said housing for detecting a real-time location of said auxiliary sensor, said central sensor generating an operating signal corresponding to a location of said beacon signal and sending said operating signal to said processor for rotating said housing toward said beacon signal location.

8. The fan of claim 6, wherein said power means comprises:

a motor secured within said housing and electrically coupled to said processor; and a beveled gear assembly positioned about said support shaft and operably mated with said power means motor for causing said support shaft to rotate relative to said housing.

9. The fan of claim 8, wherein said beveled gear assembly comprises:

a drive shaft conjoined to said power means motor;

a first gear rotatably coupled to said drive shaft; and a second gear having an annular shape situated about an outer perimeter of said support shaft;

wherein said first and second gears are operably mated in such a manner that said second gear is caused to rotate in a second direction when said first gear is rotated in a first direction, said first and second directions being oriented substantially orthogonal to each other.

10. The fan of claim 9, wherein said power means further comprises: an annular ring clip situated about the outer perimeter of said support shaft and subjacent said second gear.

11. The fan of claim 10, further comprising: a rubber seal seated about said support shaft below said ring clip, said rubber seal being intercalated between a bottom opening of said housing and the outer perimeter of said support shaft.

12. A remotely operable motorized fan comprising:

an elongated and rectilinear support shaft having top and bottom end portions axially registered along a vertical plane;

a housing defining a cavity therein and including a monolithically formed tubular lower flange protruding downwardly about said top end portion of said support shaft, said housing including a plurality of monolithically formed platforms to which said power means and said sensing means are partially secured;

sensing means for detecting a mobile target zone remotely located from said housing, said sensing means being disposed above said support shaft; and power means for rotating said housing about said support shaft based upon a location of said target zone, said power means being electrically coupled to said sensing means such that said housing automatically pivots about a vertically situated longitudinal axis bifurcating said housing without requiring a user input.

13. The fan of claim 12, wherein said sensing means comprises;

a processor for executing preprogrammed software instructions for causing said power means to operate in a selected mode;

a central sensor conjoined to said housing and partially extending outwardly therefrom, said central sensor being electrically coupled to said processor and said power means for communicating therewith during operating conditions; and an auxiliary sensor removably positional on a mobile object and including a transmitter generating and sending a beacon signal unique to said auxiliary sensor;

wherein said central sensor emits a continuous location signal throughout a predetermined radius surrounding said housing for detecting a real-time location of said auxiliary sensor, said central sensor generating an operating signal corresponding to a location of said beacon signal and sending said operating signal to said processor for rotating said housing toward said beacon signal location.

14. The fan of claim 12, wherein said power means comprises:

a motor secured within said housing and electrically coupled to said processor; and a beveled gear assembly positioned about said support shaft and operably mated with said power means motor for causing said support shaft to rotate relative to said housing.

15. The fan of claim 14, wherein said beveled gear assembly comprises:

a drive shaft conjoined to said power means motor;

a first gear rotatably coupled to said drive shaft; and a second gear having an annular shape situated about an outer perimeter of said support shaft;

wherein said first and second gears are operably mated in such a manner that said second gear is caused to rotate in a second direction when said first gear is rotated in a first direction, said first and second directions being oriented substantially orthogonal to each other.

16. The fan of claim 15, wherein said power means further comprises: an annular ring clip situated about the outer perimeter of said support shaft and subjacent said second gear.

17. The fan of claim 16, further comprising: a rubber seal seated about said support shaft below said ring clip, said rubber seal being intercalated between a bottom opening of said housing and the outer perimeter of said support shaft.

* * * * *